US010849411B1

(12) United States Patent
Chang

(10) Patent No.: US 10,849,411 B1
(45) Date of Patent: Dec. 1, 2020

(54) ADJUSTABLE STORAGE DEVICE

(71) Applicant: Teng-Yao Chang, Taichung (TW)

(72) Inventor: Teng-Yao Chang, Taichung (TW)

( * ) Notice: Subject to any disclaimer, the term of this patent is extended or adjusted under 35 U.S.C. 154(b) by 0 days.

(21) Appl. No.: 16/502,420

(22) Filed: Jul. 3, 2019

(51) Int. Cl.
*A45F 5/02* (2006.01)
*A45F 3/14* (2006.01)
*B25H 3/00* (2006.01)

(52) U.S. Cl.
CPC ..... *A45F 3/14* (2013.01); *A45F 5/02* (2013.01); *B25H 3/00* (2013.01); *A45F 2003/144* (2013.01); *A45F 2200/0575* (2013.01)

(58) Field of Classification Search
CPC ..... A41D 13/0012; A45F 2200/05; A45C 2013/1007; A45C 2013/1015; Y10S 224/904
See application file for complete search history.

(56) References Cited

U.S. PATENT DOCUMENTS 4,523,702 A * 6/1985 Viio ..... A45F 5/00 206/479
4,613,068 A * 9/1986 Bianchi ..... F42B 39/02 224/242
4,804,121 A * 2/1989 Stanton ..... A63B 57/00 224/191
4,819,846 A * 4/1989 Hannemann ..... A45F 5/00 2/312
4,964,401 A * 10/1990 Taigen ..... A61F 5/028 128/876
5,370,288 A * 12/1994 Field ..... A45C 13/02 211/60.1
5,413,262 A * 5/1995 Dewire ..... A41F 9/002 2/338

(Continued)

FOREIGN PATENT DOCUMENTS

CN 2810298 Y 8/2006
DE 2413419 B1 6/1975

(Continued)

OTHER PUBLICATIONS

Examination Report for TW108116057, dated Dec. 9, 2019, Total of 9 pages.

(Continued)

*Primary Examiner* — Brian D Nash
(74) *Attorney, Agent, or Firm* — Tracy M Heims; Apex Juris, pllc.

(57) ABSTRACT

An adjustable storage device includes a sheet, a restriction band having two ends fixedly connected to the sheet, and an elastic band having a fixed end fixedly connected to a side of the sheet and a free end detachably engaged to the another side of the sheet. The restriction band and the sheet form a through hole therebetween. The elastic band either goes through or not through the through hole. Whereby, when the elastic band is provided without going through the through hole, the elastic band the sheet form a first accommodating opening therebetween; when the elastic band is provided in a manner that it goes through the through hole, the elastic band and the sheet form multiple second accommodating openings. A maximum storage size of the first accommodating opening is greater than that of each of the second accommodating openings, so that tools of various sizes can be stored.

10 Claims, 13 Drawing Sheets

(56) References Cited

U.S. PATENT DOCUMENTS 5,511,703 A * 4/1996 Ryerson ..... B25H 3/00 224/682
5,643,184 A * 7/1997 Toso ..... A47C 16/00 2/44
5,711,469 A * 1/1998 Gormley ..... A45F 5/02 224/236
5,803,332 A * 9/1998 Thompson ..... A45F 3/04 224/153
6,029,321 A * 2/2000 Fisher ..... F41C 33/001 124/35.2
6,158,642 A * 12/2000 Herbage ..... A45F 5/02 224/240
6,962,278 B2 * 11/2005 Obatake ..... A45F 5/00 224/250
8,225,976 B2 * 7/2012 Meunier ..... A45F 5/02 224/672
8,590,757 B2 * 11/2013 Frost ..... A47D 13/025 224/160
10,080,423 B1 * 9/2018 Bandlow ..... F41C 33/0227
10,448,728 B1 * 10/2019 Gregory ..... A45F 5/02
2001/0047904 A1 * 12/2001 Antonio ..... A45F 5/021 182/3
2005/0082322 A1 * 4/2005 Dziubeck ..... A45F 5/022 224/219
2008/0008731 A1 * 1/2008 Hurwitz ..... A01N 25/34 424/409
2010/0031415 A1 * 2/2010 Shadid ..... A41D 27/201 2/87
2010/0252598 A1 * 10/2010 Cragg ..... A45F 3/02 224/579
2010/0288801 A1 * 11/2010 Messner ..... A45F 5/021 224/101
2013/0119096 A1 * 5/2013 Morgan ..... A45F 3/005 224/148.1
2013/0126540 A1 * 5/2013 Vesterby ..... A45C 13/28 220/737
2013/0126566 A1 * 5/2013 Seuk ..... A45F 5/00 224/223
2014/0367427 A1 * 12/2014 Bjelde ..... F41C 33/002 224/257
2015/0173497 A1 * 6/2015 Yu ..... A45F 5/00 224/218
2015/0272249 A1 * 10/2015 Glenn ..... A41F 9/002 2/338
2016/0346571 A1 * 12/2016 Huber ..... A62B 35/0012
2016/0360870 A1 * 12/2016 Langenwalter ..... A45F 5/021
2019/0075916 A1 * 3/2019 Becker ..... A45F 5/02
2019/0184213 A1 * 6/2019 Hill ..... A62B 35/0006
2019/0281959 A1 * 9/2019 Castro ..... A46B 17/00

FOREIGN PATENT DOCUMENTS

TW M245820 U 10/2004
TW M324036 U 12/2007

OTHER PUBLICATIONS

Search Report for TW108116057, dated Dec. 9, 2019, Total of 1 page.
English Abstract for CN2810298, Total of 1 page.
English Abstract for DE2413419, Total of 1 page.
English Abstract for corresponding document, US2003218038 for TWM245820, Total of 1 page.
English Abstract for TWM324036, Total of 1 page.

* cited by examiner

ADJUSTABLE STORAGE DEVICE

BACKGROUND OF THE INVENTION

1. Technical Field

The present invention relates generally to a storage structure, and more particularly to an adjustable storage device.

2. Description of Related Art

There are a wide variety of tools available nowadays, such as screwdrivers, pliers, and wrenches, all of which have different shapes. To easily carry tools with various shapes, one usually uses a portable storage device for accommodation. Among all kinds of conventional portable storage devices, the most commonly seen type has a structure that a base material of an appropriate size is used as a sheet, on which a band is stitched thereto, and the band and the plate together form multiple accommodating openings of fixed sizes. These accommodating openings can be used to carry said various tools.

However, since these accommodating openings have fixed sizes, a user can only carry tools having matching sizes, which limits the practicality can be provided by a conventional storage device. For example, if a tool has a size smaller than that of the accommodating opening it is stored therein, the tool may not be able to securely fit in the accommodating opening and may fall easily. On the other hand, if a tool is larger than the size of an accommodating opening, it simply cannot be accommodated in such an accommodating opening, and, in such cases, a user has no choice but to look for other suitable storage devices, which is unnecessarily inconvenient.

Therefore, conventional storage devices still have room for improvement.

BRIEF SUMMARY OF THE INVENTION

In view of the above, the primary objective of the present invention is to provide an adjustable storage device, which utilizes the changes of an elastic band to allow the sizes of accommodating openings to be flexibly adjusted, whereby various tools of different sizes can be firmly placed in the accommodating openings.

The present invention provides an adjustable storage device, which includes a sheet, at least one restriction band, and an elastic band. The at least one restriction band has two ends, which are fixedly connected to the sheet, respectively, wherein the at least one restriction band and the sheet form at least one through hole therebetween. The elastic band has a fixed end and a free end, wherein the fixed end is fixedly connected to a side of the sheet, while the free end is detachably engaged to another side of the sheet. The elastic band is provided in a manner that it either goes through or not goes through the at least one through hole. When the elastic band is provided without going through the at least one through hole and the free end thereof is engaged to the another side of the sheet, the elastic band and the sheet form a first accommodating opening therebetween; when the elastic band is provided in a manner that it goes through the at least one through hole and the free end thereof is engaged to the another side of the sheet, the elastic band and the sheet form a plurality of second accommodating openings therebetween. A maximum storage size of the first accommodating opening is greater than that of each of the second accommodating openings.

By providing the elastic band through or not through the through hole, the maximum storage size of the accommodating opening formed by the elastic band can be adjusted accordingly. While in use, the size of the accommodating opening can be adjusted based on the size of the tool which is going to be placed therein. In this way, tools of various sizes can be stored by one single storage device at the same time, which improves the convenience for storing tools.

BRIEF DESCRIPTION OF THE SEVERAL VIEWS OF THE DRAWINGS

The present invention will be best understood by referring to the following detailed description of some illustrative embodiments in conjunction with the accompanying drawings, in which.

DETAILED DESCRIPTION OF THE INVENTION

Figure 1:
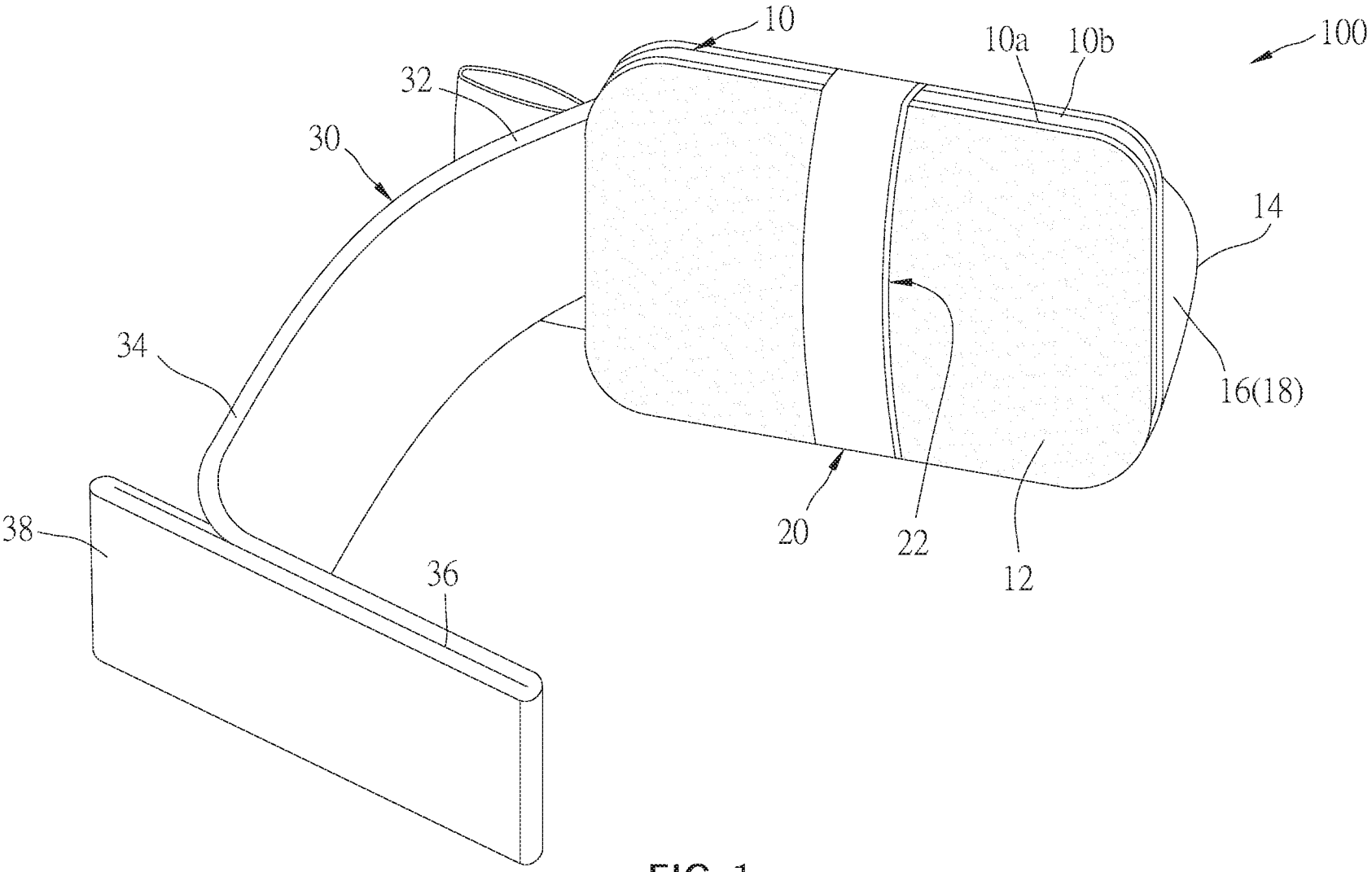
FIG. 1 is a perspective view of an adjustable storage device of a first embodiment of the present invention.
Figure 2:
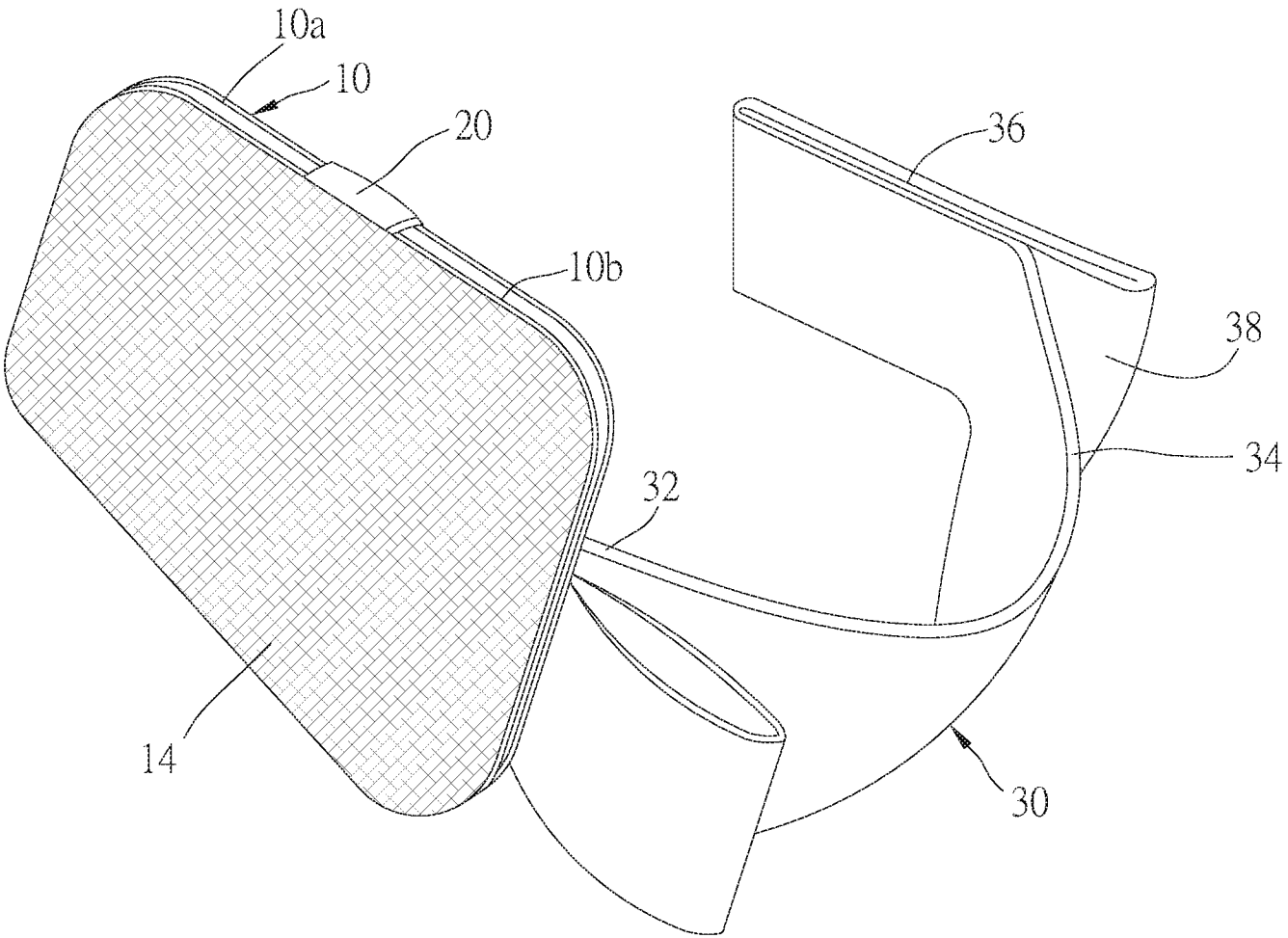
FIG. 2 is another perspective view of the adjustable storage device of the aforementioned first embodiment of the present invention.

As shown in FIG. 1 and FIG. 2, an adjustable storage device 100 of a first embodiment of the present invention includes a sheet 10, a restriction band 20, and an elastic band 30, wherein the sheet 10 is planar, which is made by selecting an appropriate size from a base material. The sheet 10 has a first surface 10*a* and a second surface 10*b*, and the first surface 10*a* is opposite to the second surface 10*b*. The first surface 10*a* is provided with a first engaging member 12, and the second surface 10*b* is provided with a second engaging member 14, wherein a side of the second engaging member 14 and the second surface 10*b* form an opening 16 and an accommodating pocket 18 therebetween. The opening 16 communicates with the accommodating pocket 18. In the current embodiment, the sheet 10 is made of plastic.

Two ends of the restriction band 20 are fixedly connected to the first surface 10*a* of the sheet 10, respectively, so that the restriction band 20 and the sheet 10 form at least one through hole 22 therebetween.

The elastic band 30 is a long and elastic band, which has a fixed end 32, a free end 34, a fastening member 36, and a grip 38. The fixed end 32 is provided on a side of the sheet 10, and the free end 34 is detachably engaged to another side of the sheet 10. More specifically, the elastic band 30 could either pass through or not pass through the at least one through hole 22 when the free end 34 is engaged to the another side of the sheet 10. In other words, the free end 34 could enter the opening 16 of the sheet 10 and get disposed in the accommodating pocket 18. The fastening member 36 is provided on the free end 34 and is connected to the grip 38. When the fastening member 36 is detachably provided in the accommodating pocket 18, the grip 38 could be pulled to make the fastening member 36 leave the accommodating pocket 18. In the current embodiment, the number of the at least one through hole 22 is one. In more details, the through hole 22 has a first side 22*a* and a second side 22*b*, wherein the first side 22*a* is opposite to the second side 22*b*. The first side 22*a* is near the fixed end 32 of the elastic band 30, and the second side 22*b* is away from the fixed end 32 of the elastic band 30.

Figure 3A:
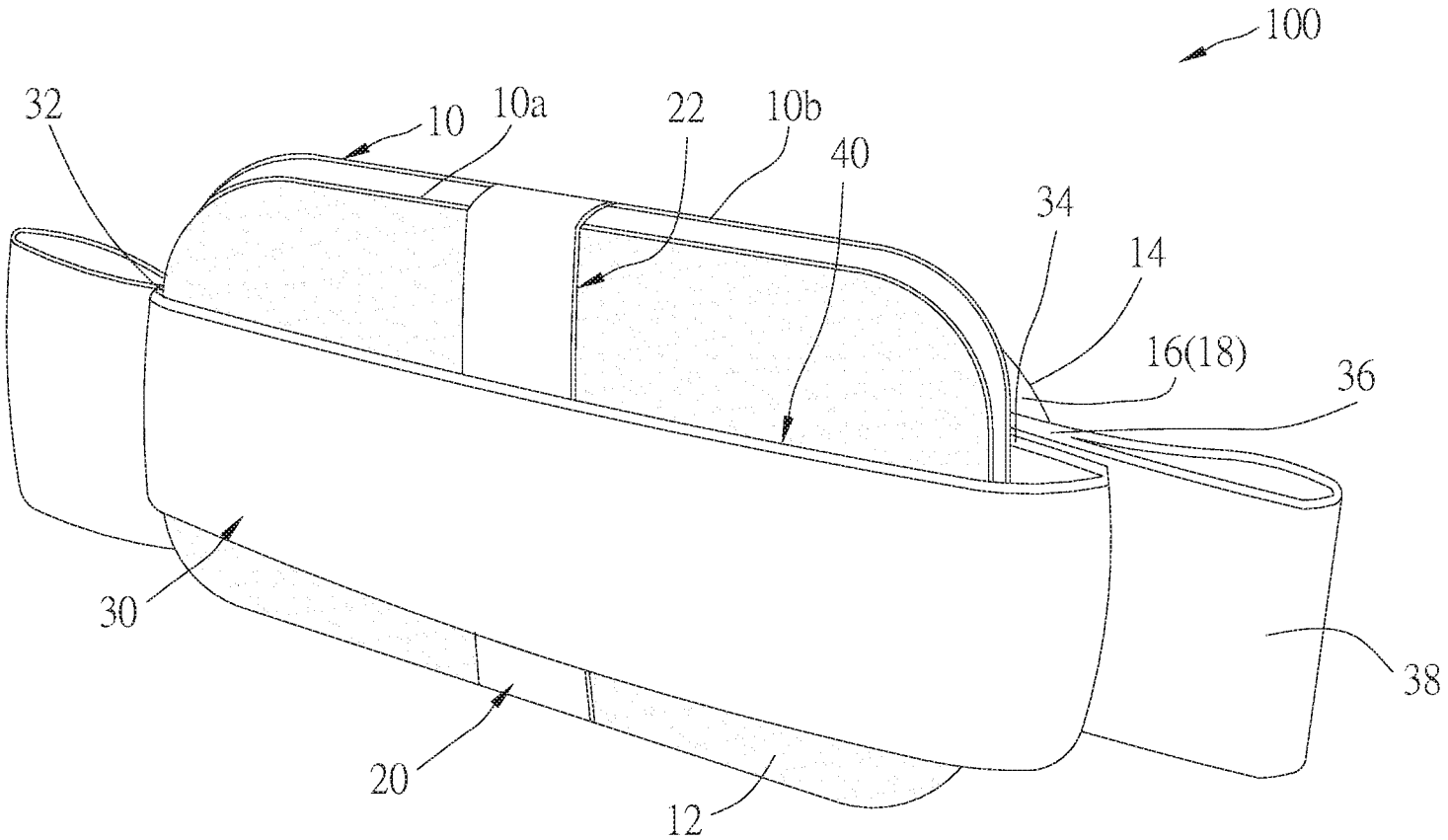
FIG. 3A is a perspective view of the adjustable storage device viewed from the side, showing the first accommodating opening.
Figure 3B:
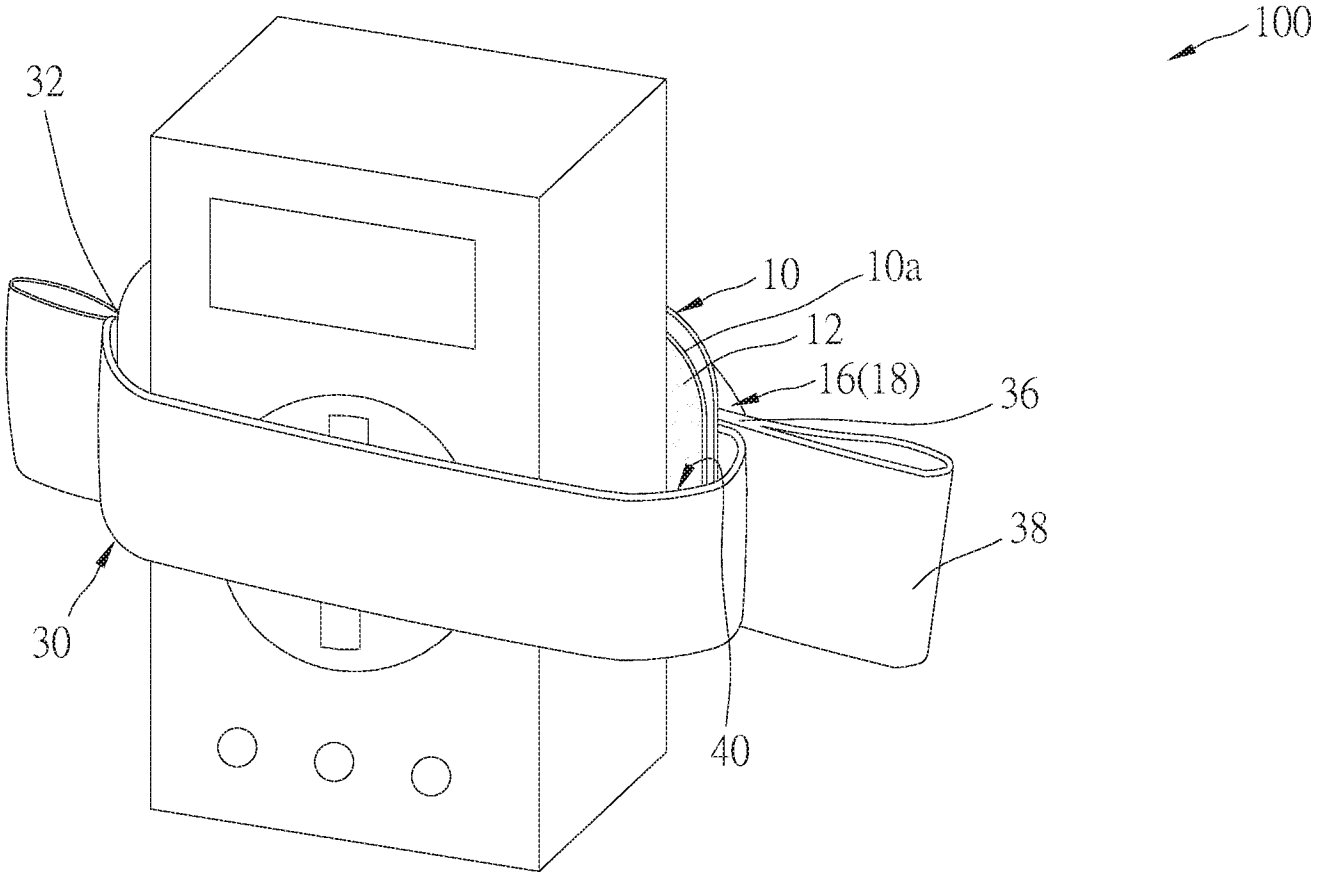
FIG. 3B is a perspective view of the adjustable storage device viewed from the side, showing a tool is stored in the first accommodating opening.

As shown in FIG. 3A and FIG. 3B, if the elastic band 30 does not pass through the through hole 22 when the free end 34 is engaged to the another side of the sheet 10, the elastic band 30 and the sheet 10 form a first accommodating opening 40 therebetween, which could be used to store a tool. Specifically, when the free end 34 is received in the accommodating pocket 1 through the opening 16 of the sheet 10 and the elastic band 30 does not pass through the through hole 22, the grip 38 could be pulled outward relative to the opening 16, so that the free end 34 could leave the accommodating pocket 18 as a result. The multimeter illustrated in FIG. 3B as being stored in the first accommodating opening 40 is merely an example, and of course, is not a limitation of the present invention.

Figure 4:
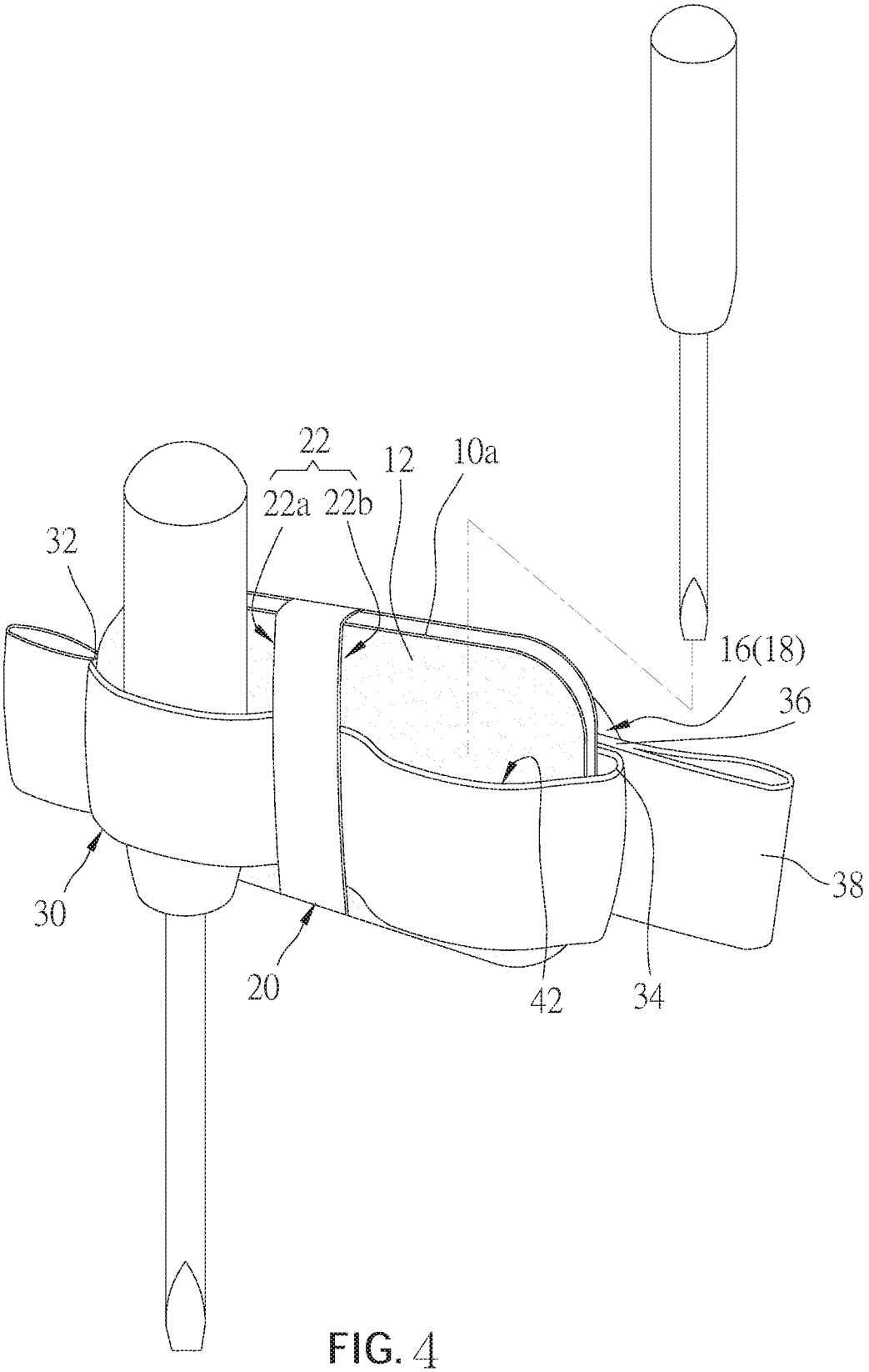
FIG. 4 is a schematic view showing how to use the adjustable storage device to store tools, and the second accommodating opening is shown therein.

As shown in FIG. 4, when the free end 34 is engaged with the another side of the sheet 10 after passing through the through hole 22 (more specifically, when the free end 34 is engaged with the another side of the sheet 10 after passing through the through hole 22 in a direction from the first side 22*a* toward the second side 22*b*), the elastic band 30 and the sheet 10 form multiple second accommodating openings 42 therebetween. These second accommodating openings 42 can be used to store tools. In an example shown in FIG. 4, each of the second accommodating openings 42 respectively holds a slotted screwdriver therein.

It should be understandable from FIG. 3B and FIG. 4 that the first accommodating opening 40 has a maximum storage size, and the maximum storage size of the first accommodating opening 40 is defined as a maximum receivable size for any object received therein. As shown in the current embodiment, each of the second accommodating openings 42 also has its maximum storage size, and the maximum storage size of the first accommodating opening 40 is greater than the maximum storage size of each of the second accommodating opening 42. For example, the multimeter stored in the first accommodating opening 40 cannot be accommodated in any of the second accommodating openings 42 because the maximum storage size of each of the second accommodating opening 42 is not sufficient for encompassing the multimeter, but the maximum storage size of the first accommodating opening 40 is greater than or equal to an outline size of the multimeter, and therefore a user could, when necessary, adjust the elastic band 30 of the adjustable storage device 100 to make it have the first accommodating opening 40, so that the multimeter could be stored in the first accommodating opening 40 of the storage device 100. On the other hand, though the screwdriver stored in the second accommodating opening 42 can be put into the first accommodating opening 40, the elastic band 30 would not be able to tightly hold the screwdriver since the maximum storage size of the first accommodating opening 40 is way greater than the size of the screwdriver. In other words, it would be also inappropriate to store a screwdriver in the first accommodating opening 40, for the screwdriver would be much easier to fall out of the first accommodating opening 40.

Figure 5:
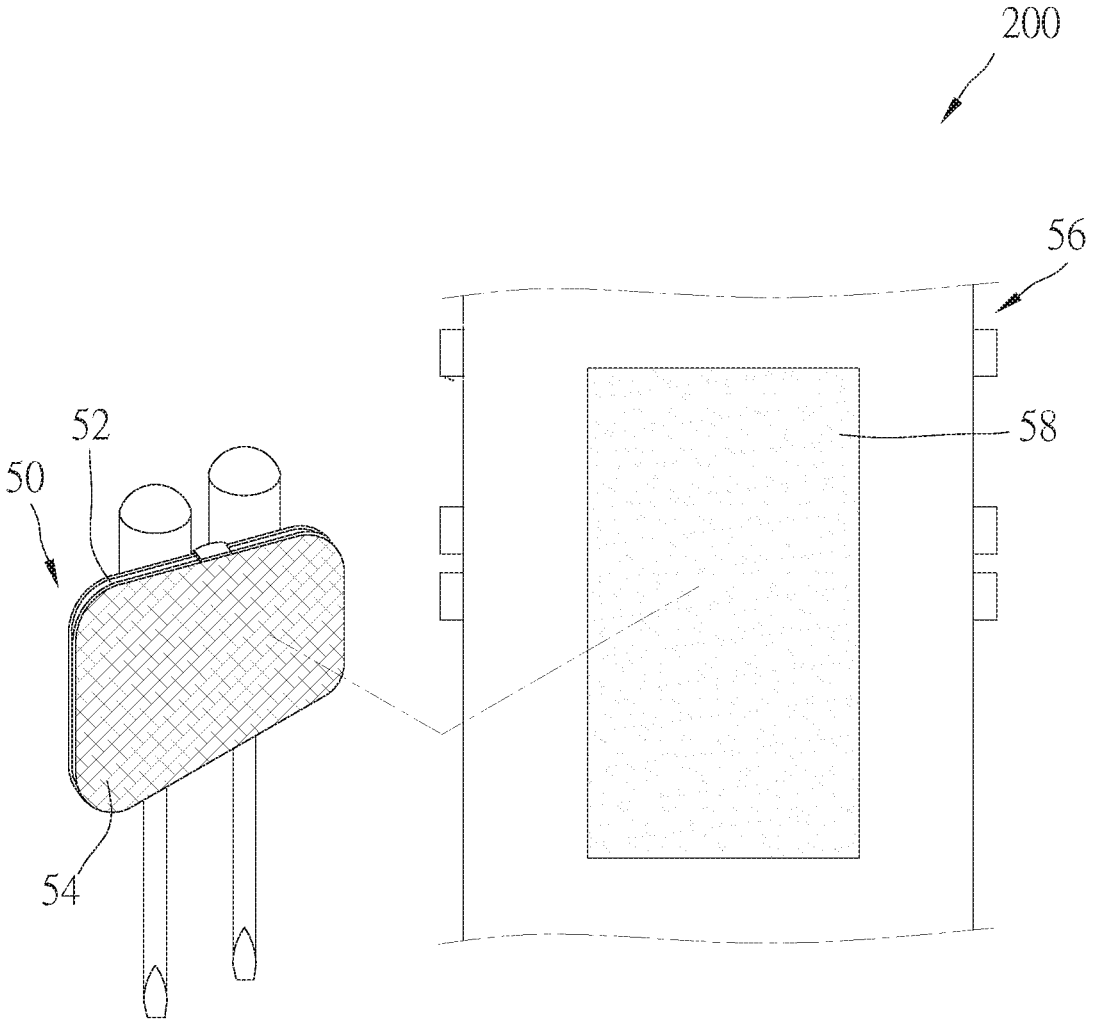
FIG. 5 is a schematic view of an adjustable storage device of a second embodiment of the present invention, showing how the components are assembled.

As shown in FIG. 5, an adjustable storage device 200 of a second embodiment of the present invention has similar structures with the first embodiment, except that a sheet 50 thereof has a second engaging member 54 provided on a second surface 52 thereof, wherein the second engaging member 54 is detachably engaged with an engaging portion 58 of a carrier 56, which would make the storage tool even more convenient to use. In the current embodiment, the second engaging member 54 is a hook side of a hook-and-loop fastener as an example, and the carrier 56 is a backpack as an example, where the engaging portion 58 of the carrier 56 is a loop side of the hook-and-loop fastener as an example. However, this is not a limitation of the present invention. By engaging the loop side on the backpack with the hook side of the second surface 52, the sheet 50 could be attached to the loop side of the backpack. Since there is no need to hold the sheet 50 by hand, it would not hinder the movement of the user. In practice, the hook side and the loop side could be provided in the opposite way, i.e., the hook side could be the engaging portion 58 of the carrier 56, and the loop side could be the second surface 52 of the sheet 50, by which the engaging portion 58 and the second surface 52 could still provide the effect of engaging with each other. Similarly, the carrier 56 is not limited to be a backpack, as long as the carrier 56 has the engaging portion 58 and is attachable to other objects, it should be considered fall within the scope of the present invention. For example, a jacket having a hook side or a loop side, or a suitcase having a hook side or a loop side could also be deemed the aforementioned carrier 56.

Figure 6A:
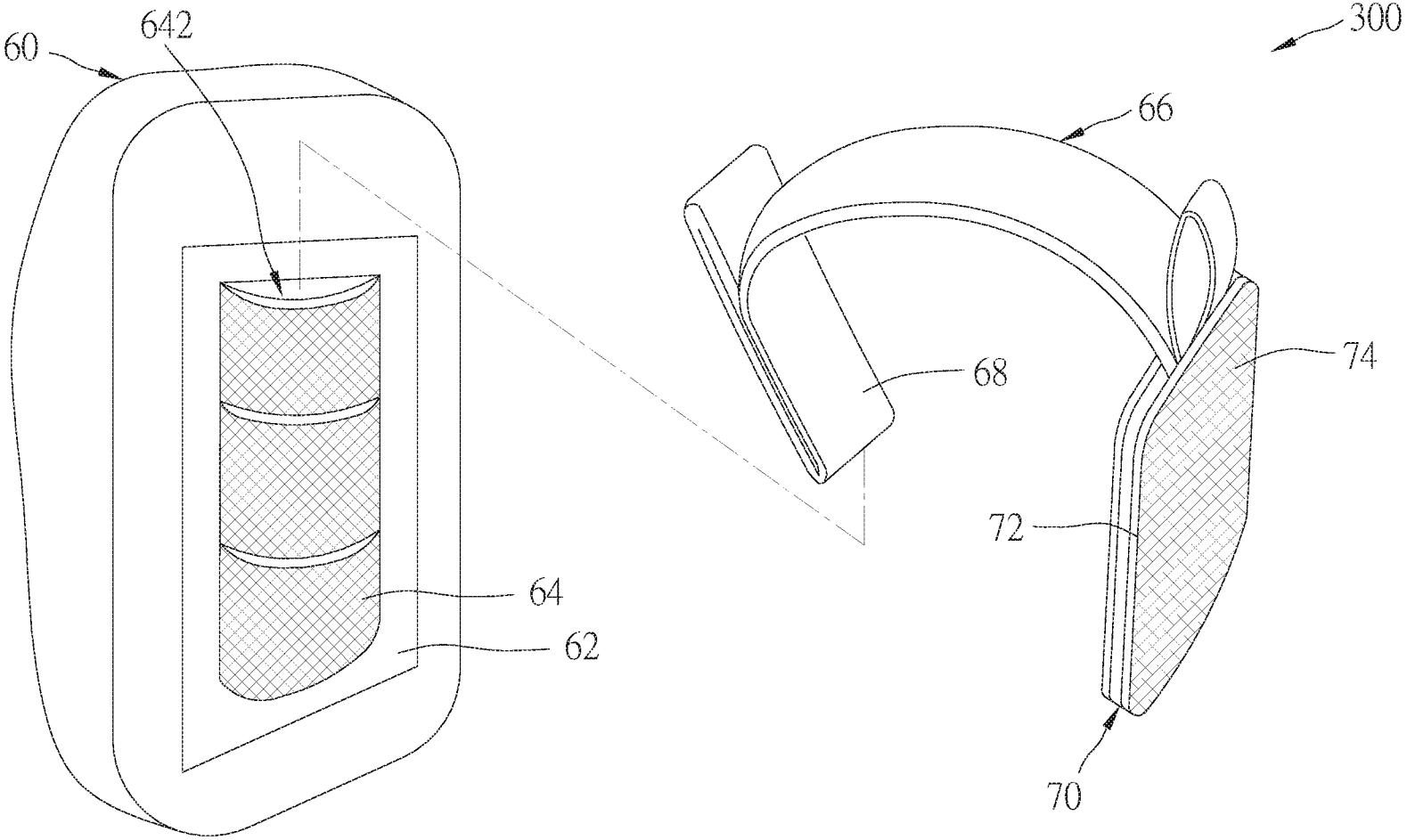
FIG. 6A is a schematic view of an adjustable storage device of a third embodiment of the present invention, showing how the components are linked together.
Figure 6B:
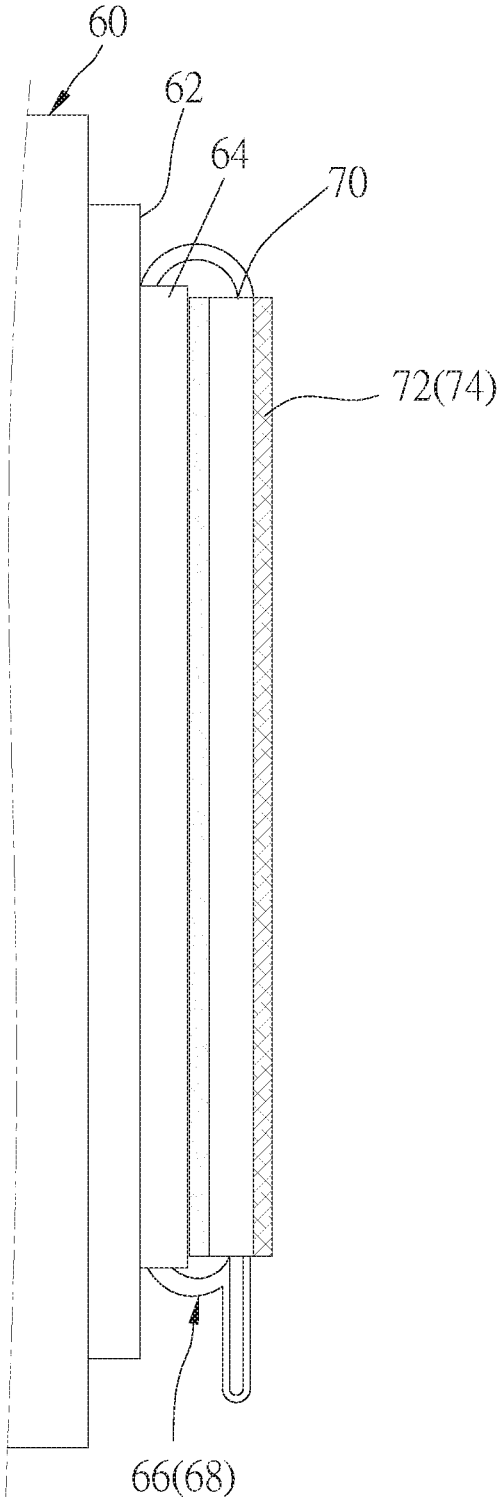
FIG. 6B is a schematic view showing the condition of the adjustable storage device shown in FIG. 6A when it is being used.
Figure 6C:
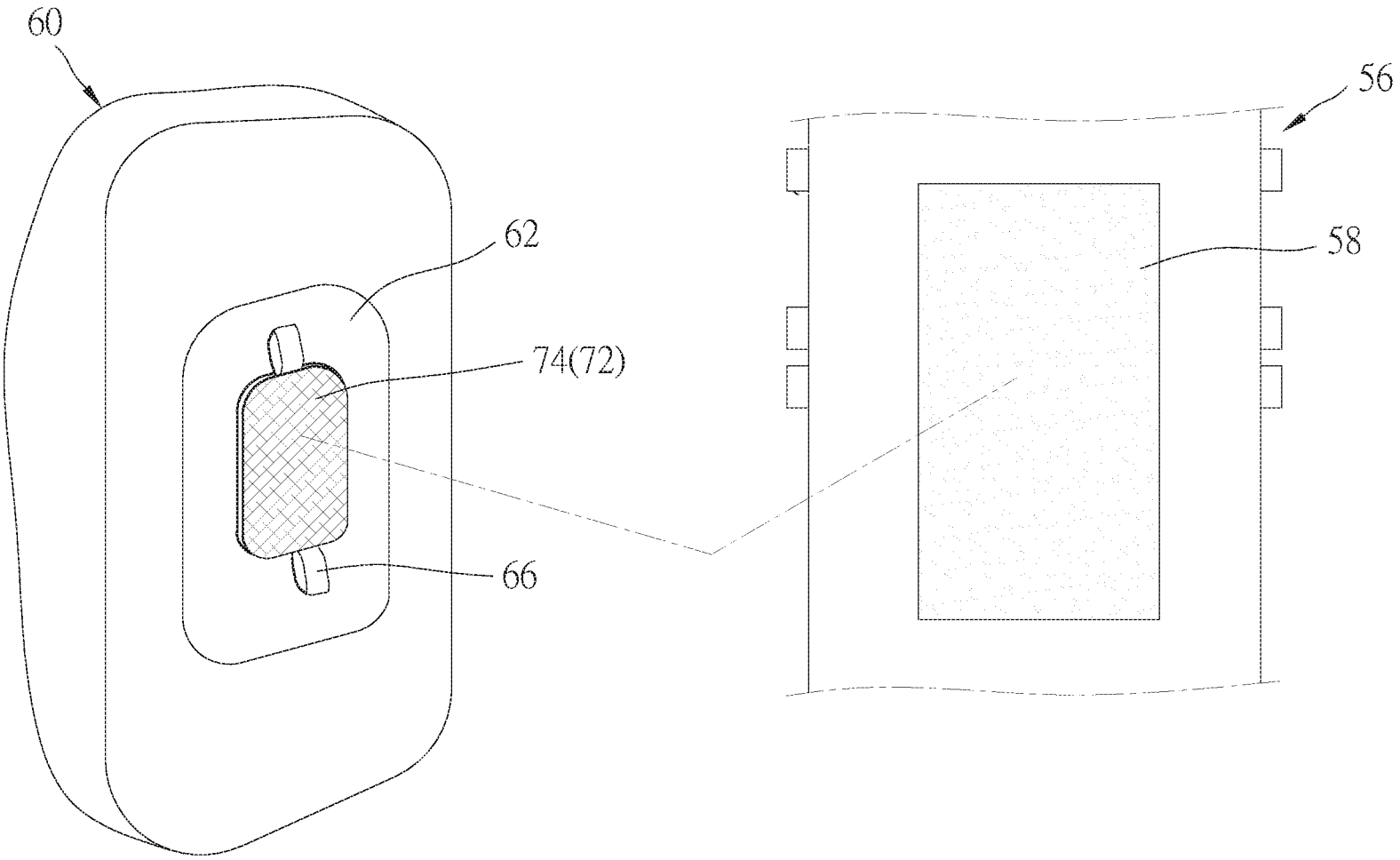
FIG. 6C is a schematic view showing how the components of the adjustable storage device shown in FIG. 6B are assembled.

As shown in FIG. 6A, FIG. 6B, and FIG. 6C, an adjustable storage device 300 of a third embodiment of the present invention has similar structures with the second embodiment, except that the third embodiment further includes another carrier 60, which is a belt-bag as an example. The another carrier 60 has at least one band provided on a surface 62 thereof, wherein the bands 64 are arranged in a vertical direction and across the surface 62. In this way, the bands 64 and the surface 62 form at least one passage 642 therebetween, wherein the passage 642 is adapted to be passed through by a free end 68 of an elastic band 66 in a detachable manner. Furthermore, the free end 68 is engaged with a side of a sheet 70, so that a second engaging member 74 provided on a second surface 72 of the sheet 70 could be exposed. With such design, the second engaging member 74 could be engaged with the engaging portion 58 of the carrier 56, which is the loop side of a hook-and-loop fastener as an example, and whereby it would no need for a user to carry the belt-bag by hand, which is convenient to use. In the current embodiment, the second engaging member 74 is a hook side of the hook-and-loop fastener as an example, but this is not a limitation of the present invention. The number of the at least one band 64 is three, and therefore the bands 64 and the surface 62 of the another carrier 60 form three passages 642 therebetween. However, in practice, there could be more than three bands 642, say five bands 642 in total, and a length of the elastic band fixedly provided on the sheet could be extended or shortened according to the number of the at least one band 642.

Figure 7:
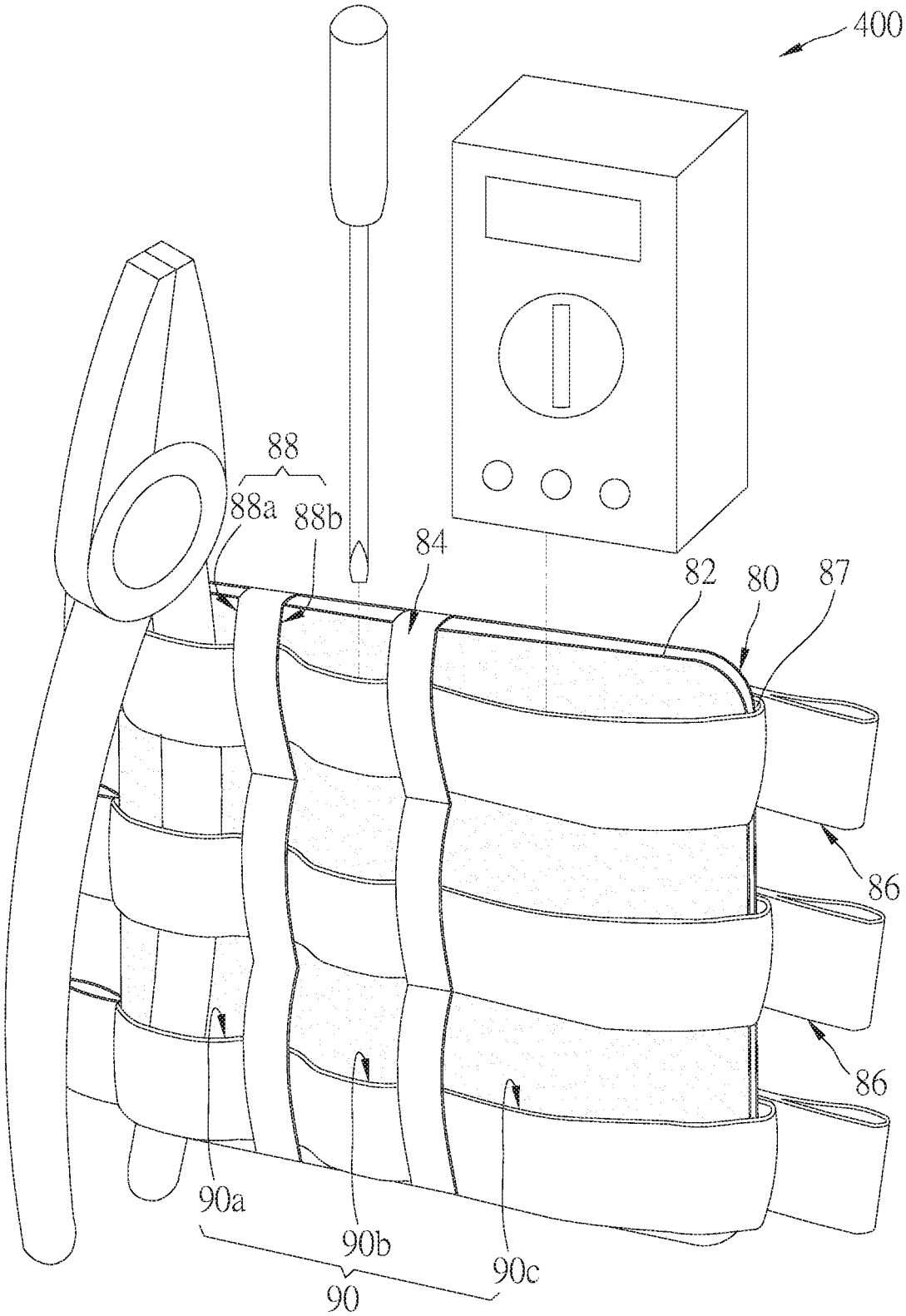
FIG. 7 is a schematic view of an adjustable storage device of a fourth embodiment of the present invention, showing how it is used to store tools.

As shown in FIG. 7, an adjustable storage device 400 of a fourth embodiment of the present invention has similar structures with the first embodiment, except that a sheet 80 of the fourth embodiment has a larger first surface 82 and a second surface (not shown). Two ends of each of multiple restriction bands 84 are fixedly connected to the sheet 80, respectively, and the restriction bands 84 and the sheet 80 form the through holes 88 therebetween. Each of the through holes 88 has a first side 88*a* and a second side 88*b*, wherein the first side 88*a* and the second side 88*b* are opposite sides, and the first side 88*a* is near the fixed end 32 of the elastic band 86, while the second side 88*b* is away from the fixed end 32 of the elastic band 86. When each of the elastic bands 86 gets engaged in one of multiple accommodating pockets (not shown), respectively, without passing through any of the through holes 88, the elastic bands 86 and the sheet 80 form a third accommodating opening (not shown) therebetween; when the elastic bands 86 pass through at least one of the through holes 88 in a direction from the first side 88*a* toward the second side 88*b* to be engaged with the accommodating pockets of the sheet 80, respectively, the elastic bands 86 and the sheet 80 form multiple fourth accommodating openings 90 therebetween, and a maximum storage size of the third accommodating opening is greater than a maximum storage size of the fourth accommodating openings 90.

In the current embodiment, the number of the restriction bands 84 is two, and the number of the elastic bands 86 is three. Each of the restriction band 84*s* and the sheet 80 form multiple through holes 88 therebetween. The free end 87 of the elastic bands 86 sequentially passes through the restriction bands 84 before getting engaged in the accommodating pockets of the sheet 80, whereby to form the fourth accommodating openings 90 therebetween. From the left side to the right side of FIG. 7, the fourth accommodating openings 90 are, sequentially, the fourth accommodating opening denoted as 90*a*, the fourth accommodating opening denoted as 90*b*, and the fourth accommodating opening denoted as 90*c*, each of which is adapted to store a tool of an appropriate outline size. For example, the tools stored in the fourth accommodating openings 90 are, from the left side to the right side of FIG. 7, a pair of lineman's pliers, a screwdriver, and a multimeter. As can be seen from FIG. 7, the fourth accommodating openings 90 have different maximum storage size. More specifically, while the lineman's pliers could be received in the rightmost fourth accommodating opening 90*c*, the multimeter would not be able to fit in the leftmost fourth accommodating opening 90*a*, for the maximum storage size of the leftmost fourth accommodating opening 90*a* is not sufficient for holding the multimeter; on the other hand, the maximum storage size of the rightmost fourth accommodating opening 90*c* is greater than or equal to the outline size of the multimeter.

Figure 8:
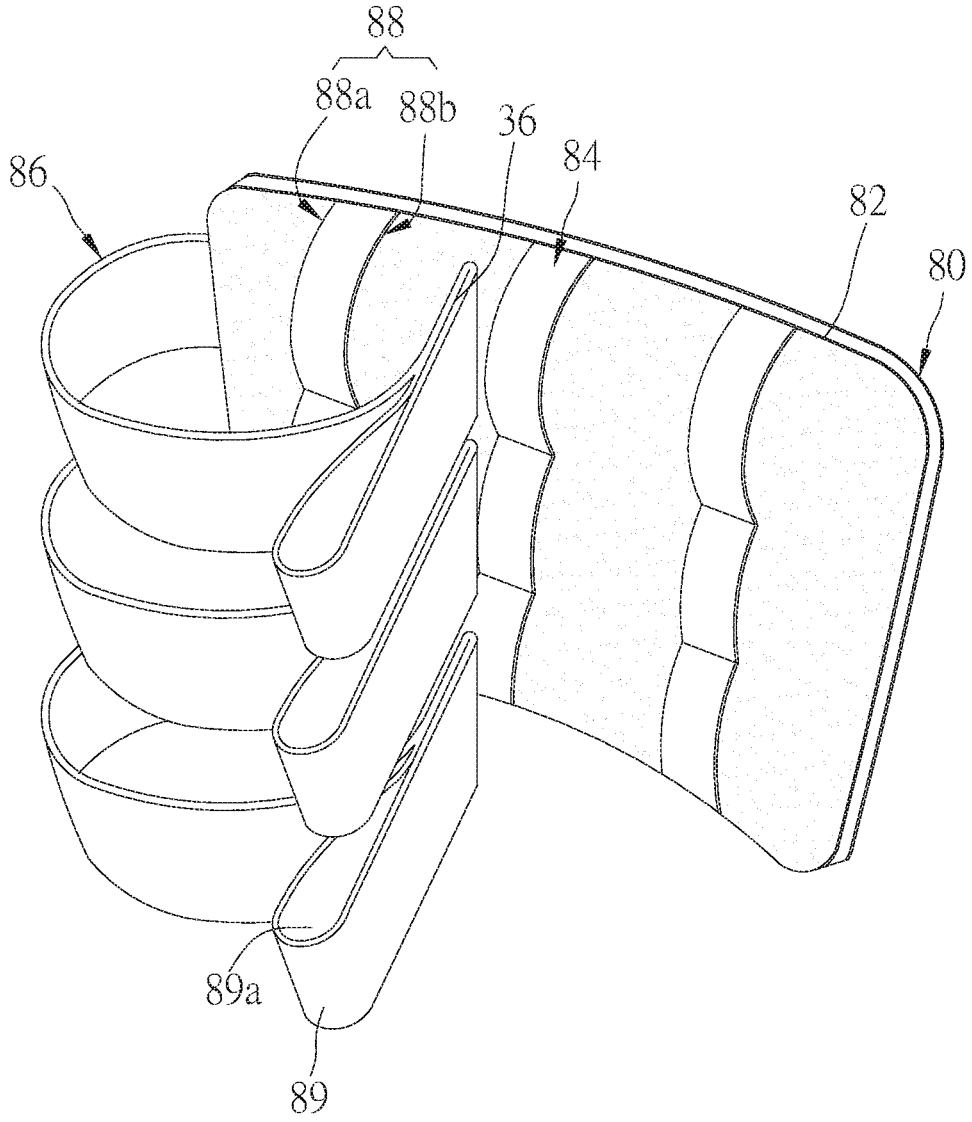
FIG. 8 is a perspective view of an adjustable storage device of a fifth embodiment of the present invention, showing the elastic band is provided through the restriction band.
Figure 9:
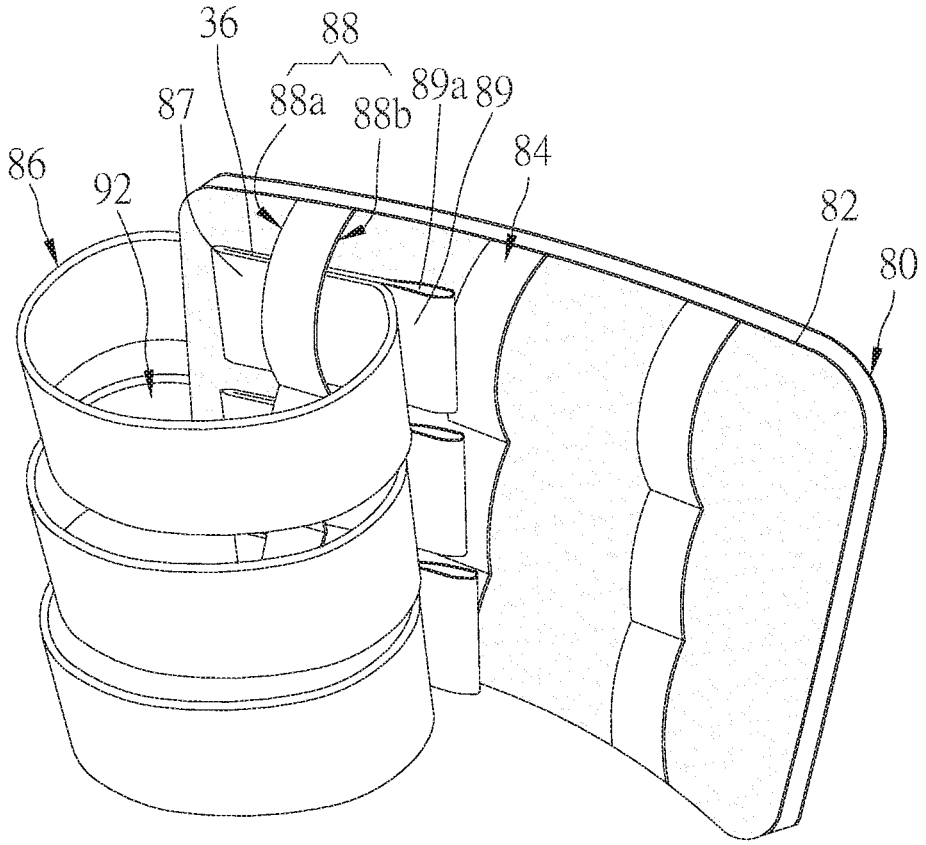
FIG. 9 is a perspective view of the adjustable storage device of the fifth embodiment of the present invention, showing the fifth accommodating opening.
Figure 10:
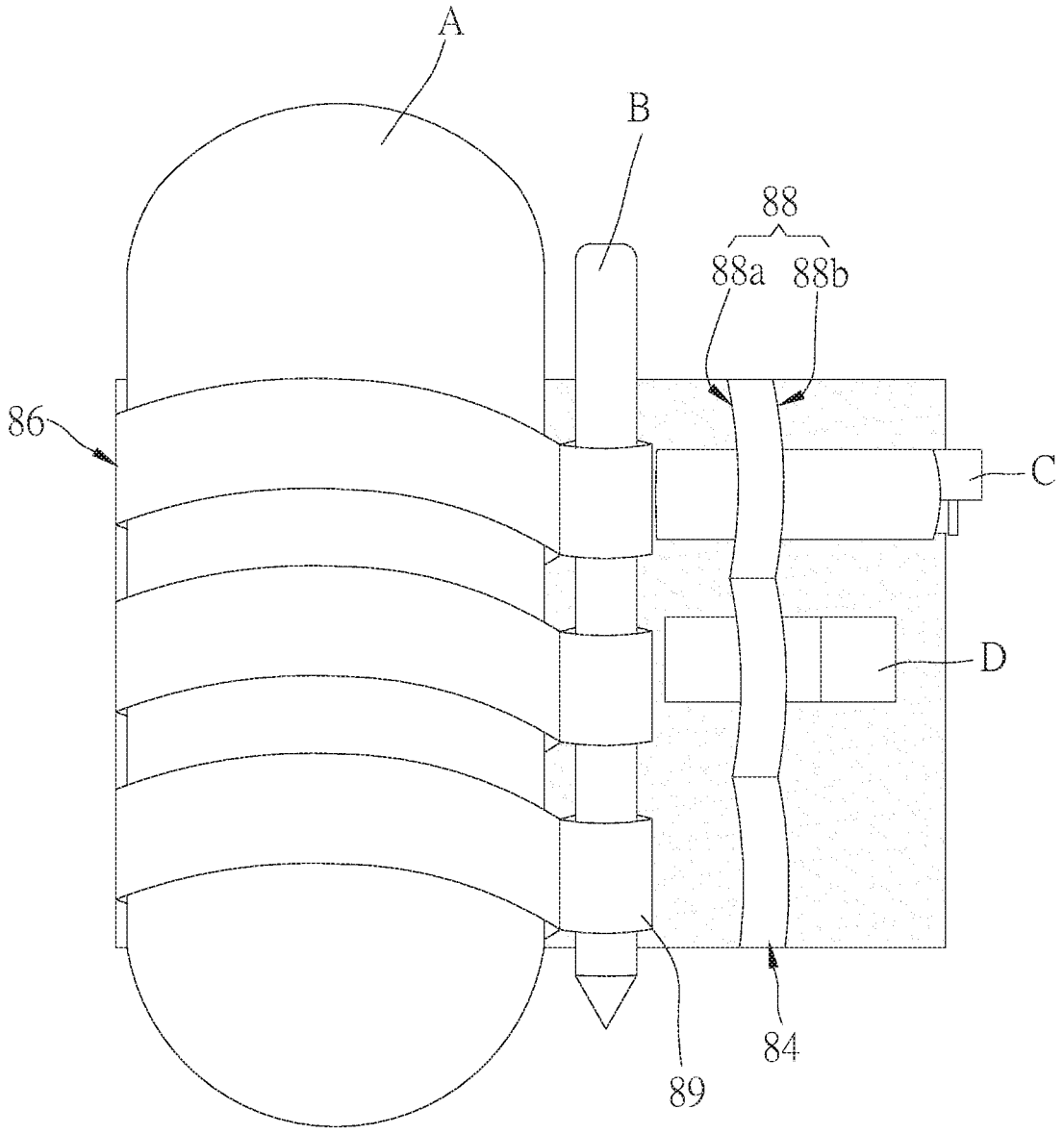
FIG. 10 is a schematic view showing how the adjustable device of the fifth embodiment can be used to store tools.

As shown in FIG. 8 to FIG. 10, an adjustable storage device of a fifth embodiment of the present invention has similar structures with the fourth embodiment, except that the elastic bands 86 of the fifth embodiment pass through at least one of the through holes 88 in a direction from the second side 88*b* toward the first side 88*a*, forming multiple fifth accommodating openings 92 between the elastic bands 86 and the sheet 80. In more details, in the current embodiment, the fastening member 36 of each of the elastic bands 86 goes into the second side 88*b* of the through holes 88 and gets out from the first side 88*a*. Each of the fastening members 36 is disposed on the first surface 82 of the sheet 80, and each of the grips 89 is exposed on the second side 88*b* of the through holes 88, whereby the elastic bands 86 and the sheet 80 form the fifth accommodating openings 92 therebetween, and the fifth accommodating openings 92 have a maximum storage size capable of receiving objects such as a sleeping bag.

It is worth mentioning that, the grip 89 of each of the elastic bands 86 has an accommodating tube 89*a*, which is hollow and tubular, and is made by sewing a piece of cloth. In the current embodiment, the accommodating tubes 89*a* are adapted to hold pens such as a pencil B, which is apparently not a limitation of the present invention. The accommodating tubes 89*a* are also adapted to store lighting instruments such as a flashlight. Unoccupied through holes 88 could be also adapted to store objects of suitable sizes, such as a lighter C, a USB flash drive, etc., for examples.

Based on the above descriptions, by making different numbers of the elastic bands pass through the restriction bands, the restriction bands and the sheet could form the accommodating openings of changeable maximum storage sizes therebetween. In other words, if the elastic bands do not pass through any of the restriction bands, the accommodating openings would have a greater maximum storage size; if any of the elastic bands pass through any of the restriction bands, the accommodating openings would have a smaller maximum storage size. By utilizing the elastic bands and restriction bands in different ways, the maximum storage sizes could be changed for receiving tools of various sizes.

It must be pointed out that the embodiments described above are only some preferred embodiments of the present invention. All equivalent structures which employ the concepts disclosed in this specification and the appended claims should fall within the scope of the present invention.

What is claimed is:

1. An adjustable storage device, comprising:

a sheet;

at least one restriction band, of which two ends are fixedly connected to the sheet, respectively, wherein the at least one restriction band and the sheet form at least one through hole therebetween;

an elastic band, which has a fixed end and a free end, wherein the fixed end is fixedly connected to a side of the sheet, while the free end is detachably engaged to another side of the sheet; the elastic band is provided in a manner that it either goes through or not goes through the at least one through hole; and a first engaging member provided on a first surface of the sheet, wherein the first engaging member is detachably engaged with an engaging portion of a carrier;

a second engaging member, which is provided on a second surface of the sheet, and is detachably engaged with the engaging portion of the carrier, wherein the second surface is opposite to the first surface;

wherein, when the elastic band is provided without going through the at least one through hole and the free end thereof is engaged to the another side of the sheet, the elastic band and the sheet form a first accommodating opening therebetween; when the elastic band is provided in a manner that it goes through the at least one through hole and the free end thereof is engaged to the another side of the sheet, the elastic band and the sheet form a plurality of second accommodating openings therebetween;

wherein, a maximum storage size of the first accommodating opening is greater than that of each of the second accommodating openings.

2. The adjustable storage device of claim 1, wherein one of the first engaging member and the engaging portion comprises a hook side of a hook-and-loop fastener, while the other one of the first engaging member and the engaging portion comprises a loop side of the hook-and-loop fastener; the hook side and the loop side are adapted to be fastened to each other.

3. The adjustable storage device of claim 1, wherein one of the second engaging member and the engaging portion comprises a hook side of a hook-and-loop fastener, while the other one of the second engaging member and the engaging portion comprises a loop side of the hook-and-loop fastener; the hook side and the loop side are adapted to be fastened to each other.

4. The adjustable storage device of claim 1, wherein the elastic band passes through at least one passage of another carrier with the free end thereof detachably engaged to the another side of the sheet, so that the second engaging member provided on the second surface is exposed.

5. The adjustable storage device of claim 4, wherein one of the second engaging member and the engaging portion comprises a hook side of a hook-and-loop fastener, while the other one of the second engaging member and the engaging portion comprises a loop side of the hook-and-loop fastener; the hook side and the loop side are adapted to be fastened to each other.

6. The adjustable storage device of claim 1, wherein the at least one restriction band comprises more than one restriction band, and two ends of each of the restriction bands are fixedly connected to the sheet, respectively, so that the at least one through hole formed between the restriction bands and the sheet comprises more than one through hole; when the elastic band is connected to the another side of the sheet without going through the through holes, the elastic band and the sheet form a third accommodating opening therebetween; when the elastic band is connected to the another side of the sheet and passes through at least one of the through holes, the elastic band and the sheet form a plurality of fourth accommodating opening therebetween; wherein a maximum storage size of the third accommodating opening is greater than that of each of the fourth accommodating openings.

7. The adjustable storage device of claim 1, wherein the at least one through hole has a first side and a second side opposite to the first side; the first side is near the fixed end of the elastic band, and the second side is away from the fixed end of the elastic band; the elastic band passes through at least one of the at least one through hole in a direction from the first side toward the second side, and the elastic band is engaged to the another side of the sheet to form the second accommodating openings therebetween.

8. An adjustable storage device, comprising:

a sheet;

at least one restriction band, of which two ends are fixedly connected to the sheet, respectively, wherein the at least one restriction band and the sheet form at least one through hole therebetween; the at least one through hole has a first side and a second side opposite to the first side; and an elastic band, which has a fixed end and a free end, wherein the fixed end is fixedly connected to a side of the sheet, and the free end is detachably connected to the through hole;

an engaging member, which is provided on a surface of the sheet, and is detachably engaged with an engaging portion of a carrier;

wherein the first side is near the fixed end of the elastic band, and the second side is far away from the fixed end of the elastic band; when the elastic band passes through the at least one restriction band in a direction from the second side toward the first side, the elastic band and the sheet form an accommodating opening therebetween;

wherein the surface of the sheet and the engaging member form an accommodating pocket therebetween; the elastic band has a fastening member provided at the free end thereof, wherein the fastening member is detachably disposed in the accommodating pocket.

9. An adjustable storage device, comprising:

a sheet;

at least one restriction band, of which two ends are fixedly connected to the sheet, respectively, wherein the at least one restriction band and the sheet form at least one through hole therebetween;

an elastic band, which has a fixed end and a free end, wherein the fixed end is fixedly connected to a side of the sheet, while the free end is detachably engaged to another side of the sheet; the elastic band is provided in a manner that it either goes through or not goes through the at least one through hole; and an engaging member, which is provided on a surface of the sheet, and is detachably engaged with an engaging portion of a carrier;

wherein, when the elastic band is provided without going through the at least one through hole and the free end thereof is engaged to the another side of the sheet, the elastic band and the sheet form a first accommodating opening therebetween; when the elastic band is provided in a manner that it goes through the at least one through hole and the free end thereof is engaged to the another side of the sheet, the elastic band and the sheet form a plurality of second accommodating openings therebetween;

wherein, a maximum storage size of the first accommodating opening is greater than that of each of the second accommodating openings;

wherein the surface of the sheet and the engaging member form an accommodating pocket therebetween; the elastic band has a fastening member provided at the free end thereof, wherein the fastening member is detachably disposed in the accommodating pocket.

10. The adjustable storage device of claim 9, wherein the elastic band has a grip, which is provided at the free end, and is connected to the fastening member; when the fastening member is disposed in the accommodating pocket, the grip is adapted to be pulled to make the fastening member leave the accommodating pocket.

* * * * *